US005368266A

United States Patent [19]

Allen

[11] Patent Number: 5,368,266

[45] Date of Patent: Nov. 29, 1994

[54] FLOWER SUPPORT FOR TOMBSTONES

[76] Inventor: Nolda R. Allen, 3876 Newton Falls-Bailey Rd., Newton Falls, Ohio 44444

[21] Appl. No.: 221,200

[22] Filed: Mar. 31, 1994

Related U.S. Application Data

[63] Continuation of Ser. No. 993,433, Dec. 21, 1992, abandoned.

[51] Int. Cl.[5] ..... A47G 7/00

[52] U.S. Cl. ..... 248/231.4; 47/39; 108/47; 248/311.2

[58] Field of Search ..... 248/214, 231.4, 311.2; 47/66, 39, 18 R, 41.01; 108/47; 403/306

[56] References Cited

U.S. PATENT DOCUMENTS 2,652,674 9/1953 Lee ..... 403/306 X
3,185,113 5/1965 Nathan et al. ..... 108/47
3,310,911 3/1967 Bosner et al. .
3,346,125 10/1967 Miller et al. ..... 108/47 X
3,511,461 5/1970 Clark .
4,640,045 2/1987 Nesbitt et al. .
4,836,485 6/1989 Cooper ..... 403/306 X
5,072,542 12/1991 Quackenbush .

FOREIGN PATENT DOCUMENTS 769408 3/1957 United Kingdom ..... 108/47

*Primary Examiner*—Ramon O. Ramirez
*Assistant Examiner*—Derek J. Berger
*Attorney, Agent, or Firm*—Harpman & Harpman

[57] ABSTRACT

An adjustable flower saddle removably secured to the top portion of a tombstone. The adjustable saddle has opposing movable leg pairs extending for engagement over the top edge of a tombstone or the like. Decorative objects such as a planter box are attached to the saddle for ornamental display on the tombstone. The saddle is resiliently held on the tombstone by the opposing legs.

4 Claims, 2 Drawing Sheets

FLOWER SUPPORT FOR TOMBSTONES

This is a continuation application of Ser. No. 07/993,433, filed Dec. 21, 1992, now abandoned.

BACKGROUND OF THE INVENTION

1. Technical Field

This device relates to flower and display saddles mounted on tombstones that can be selectively removed without damage to the stone.

2. Description of Prior Art

Prior art devices of this type have used a variety of different structures to engage the tombstones and provide a mounting base or container to which various displays and flower arrangements can be placed, see for example U.S. Pat. Nos. 3,310,911, 3,511,461, 4,640,045 and 5,072,542.

In U.S. Pat. No. 3,310,911 a flower pot supporting attachment for cemetery monuments can be seen having an elbow and connecting rods which clamp onto the vertical surface of the tombstone via tubular extensions that are retracted by an adjustment screw therebetween.

U.S. Pat. No. 3,511,461 discloses a floral display support for gravestones using a metal wire frame construction that can be adjusted to fit over the top and sides of a tombstone. The wire frame has resilient pads and tubular elements to prevent marring of the monument.

A flower saddle for tombstones is disclosed in U.S. Pat. No. 4,640,045 having a telescopically adjustable leg configuration for gripping the tombstone. The legs are drawn together by a central threaded elongated nut and bolt assembly positioned in spaced relation between the legs. A planter is secured to the leg assembly for display purposes.

U.S. Pat. No. 5,072,542 is directed towards a gravestone saddle planter having a planter container with an internal clip extending therefrom. The clip has flexible leg elements that can be resiliently separated and placed on the top edge of a tombstone. Pads are positioned on the respective ends of the legs that engage the stone.

SUMMARY OF THE INVENTION

A self-adjusting flower support saddle for tombstones having spring-mounted opposing pairs of rigid legs extending for resilient engagement with a tombstone. A planter configuration may be integral with the saddle defining a receptacle for flowers or the like.

DESCRIPTION OF THE PREFERRED EMBODIMENT

Figure 1:
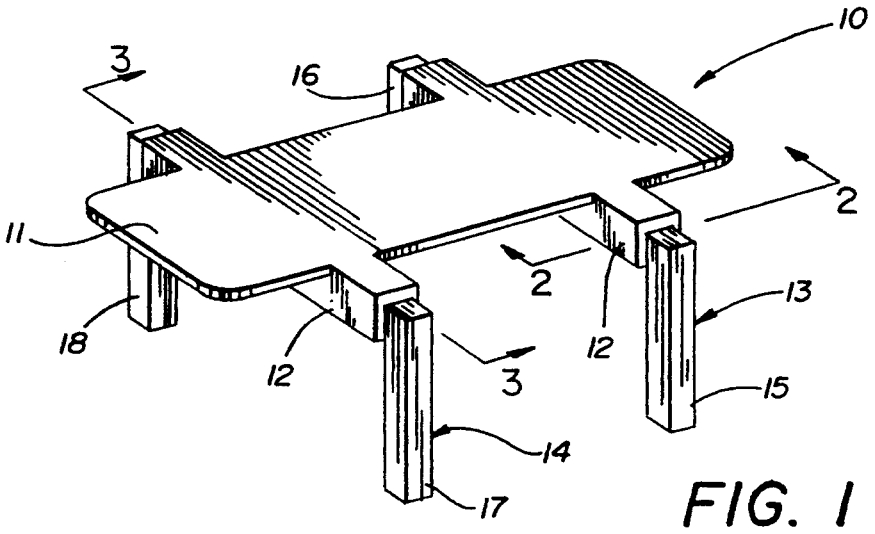
FIG. 1 is a perspective view of the adjustable saddle.
Figure 2:
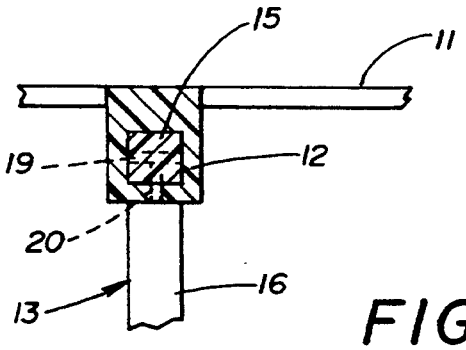
FIG. 2 is a section on lines 2—2 of FIG. 1.

Referring to FIGS. 1–3 and 7 of the drawings, an adjustable flower saddle 10 can be seen comprising a generally rectangular body member 11, having elongated integral leg supports 12 in spaced relation to one another on said body member. The leg supports 12 are tubular and extend transversely across and beyond said body member 11. Pairs of leg members 13 and 14 are adjustably positioned partially within said respective free ends of said leg supports 12. Each of said leg member pairs 13 and 14 have identical right angular leg elements 15 and 16 and 17 and 18 respectively that are notched at 19 and apertured at 20 inwardly of one respective end thereof.

Figure 3:
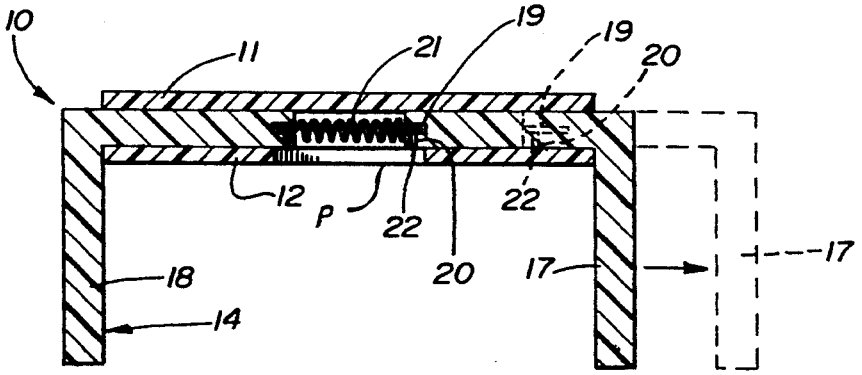
FIG. 3 is a cross-section on lines 3—3 of FIG. 1.
Figure 7:
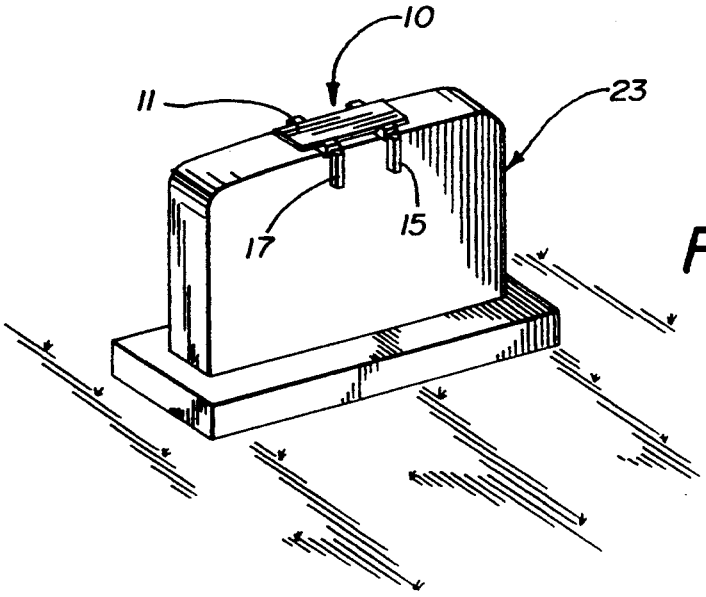
FIG. 7 is a perspective view of a tombstone with the preferred embodiment of the adjustable saddle positioned thereon.

In assembly, the adjustable flower saddle 10 has a spring element 21 positioned within said respective leg supports 12 via an access port P that is secured to and between said notched end 18 and aperture 19 of opposing leg elements 14 and 15 and 16 and 17 respectively as best seen in FIG. 3 of the drawings. Spring retaining pins 22 are affixed within said apertures at 20 passing through said notched ends at 18 securing the springs 21 to the respective leg elements 14 and 15 and 16 and 17. It will be evident from the above description that as assembled the flower saddle 10 will resiliently grip a tombstone 23 by selective extension of the respective leg elements 14 and 17 from the leg supports 12 in oppositely disposed direction to one another as best seen in FIG. 7 of the drawings. The adjustable flower saddle 10 will compensate for variations in the relative dimensional thickness of the tombstone 23.

Figure 4:
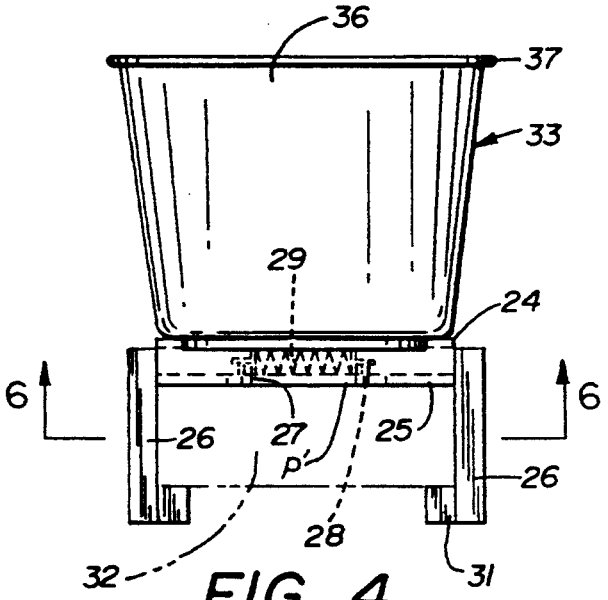
FIG. 4 is an end plan view of an alternate form of the invention.
Figure 5:
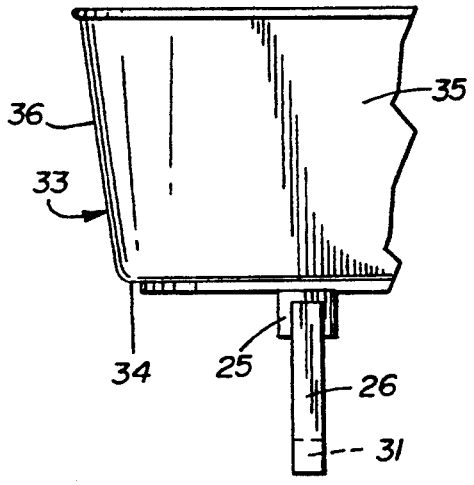
FIG. 5 is a side plan view with portions broken away of the device shown in FIG. 4.
Figure 6:
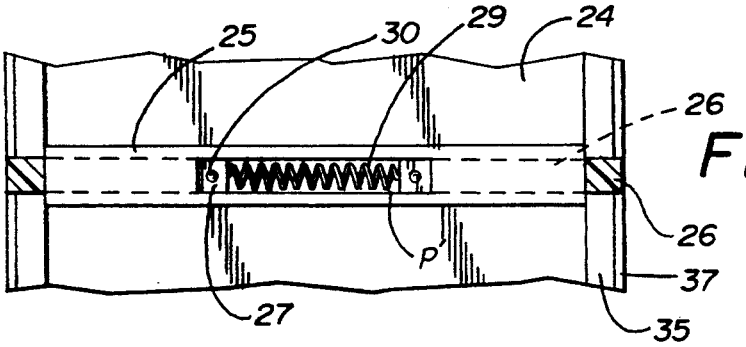
FIG. 6 is a partial section on lines 6—6 of FIG. 4 of the drawings.

Referring now to FIGS. 4–6 of the drawings, an alternate form of the invention can be seen wherein a basic flower saddle as seen in FIG. 1 has been modified having a main body member 24, a pair of spaced integral tubular leg supports 25 and multiple resilient leg elements 26 extending therefrom. Each of said leg elements 26 has a notched end 27 with an aperture therein at 28. Referring now to FIGS. 4 and 6 of the drawings, a spring 29 is positioned within said tubular leg support 23 via an access port P and secured to respective effacing notched leg ends by retaining pins 30. Each of said leg elements 26 has an angular extension 31 extending from its free end thereof. Said angular extensions 31 are co-planar with said tubular leg support 25 and act as a rail engagement when positioned on a porch rail or deck rail 32 shown in broken lines in FIG. 4 of the drawings.

A planter box 33 can be seen in FIGS. 4, 5 and 6 of the drawings permanently secured to the alternate saddle and has a bottom 34, oppositely disposed tapered side and end walls 35 and 36 and a continuous flange lip 37 defining an opening therein.

In use, the adjustable flower saddle 10 can be readily positioned on the tombstone 23 which has a top edge 37, front side 38 and back side 35 by extending the respective leg elements 15, 16, 3, 17, and 18 telescopically from their respective tubular leg supports 12 against the resistance of the attached springs 21 as seen at 40 in dotted lines in FIG. 3 of the drawings. Extended leg element pairs 13 and 14 are positioned over the tombstone 23's top edge 37 engaging said front side 38 and back side 39 respectively. Various decorations and the like (not shown) can be attached to the flower saddle 10 for display purposes.

It will thus be seen that a new and useful adjustable flower saddle has been illustrated and described and it will be apparent to those skilled in the art that various changes and modifications may be made therein without departing from the spirit of the invention, therefore I claim:

What is claimed is:

1. An adjustable flower saddle for use on grave markers and the like comprising a rectangular body member having integral leg supports thereon, pairs of multiple L-shaped right angular leg elements extending from the leg supports, each leg element including an inner end located on a leg support, a resilient element interconnecting said pairs of leg elements to one another within said leg supports, an access port in said leg support inwardly of said leg support's free end and means for securing each of said leg elements to said resilient element including a notch extending from said inner end axially along said leg element, an aperture extending from a side of said leg element transversely of said leg element and intersecting said notch and dead ending at said notch, an end of said resilient element being located in said notch, and a retaining pin in said aperture with one end of said retaining pin slideably engaging said leg support and the end of said resilient element engaging said retaining pin adjacent to another end of said retaining pin whereby said resilient element is attached to said leg element by said retaining pin and said retaining pin is held in said aperture against said leg element by said resilient element.

2. The adjustable flower saddle of claim 1 wherein said leg supports are cross-sectionally tubular, and are positioned transversely across said rectangular body member in spaced relation to one another and said leg supports extend beyond the body member.

3. The adjustable flower saddle of claim 2 wherein said cross-sectionally tubular leg supports are of a known inter-dimension, and said leg elements are of an outer dimension less than said known inner dimension, and said leg elements are registerable within said tubular leg supports for longitudinal movement within.

4. An adjustable flower saddle for use on porch deck railings, comprising a generally flat rectangular body member having integral tubular leg supports thereon, multiple L-shaped right angled leg elements extending from said respective leg supports, angled extensions on the free ends of said leg elements, said angle extensions extending inwardly towards one another in co-planar relation to said tubular leg supports, each leg element including an inner end located in a leg support, a resilient element interconnecting opposing pairs of said leg elements to one another within said respective tubular leg supports for longitudinal movement within and means for securing said leg element to said resilient elements including a notch extending from said inner end axially along said leg element, an aperture extending from a side of said leg element transversely of said leg element and interconnecting said notch and dead ending at said notch, an end of said resilient element being located in said notch, and a retaining pin in said aperture with one end of said retaining pin slideably engaging said leg support and the end of said resilient element engaging said retaining pin adjacent to another end of said retaining pin whereby said resilient element is attached to said leg element by said retaining pin and said retaining pin is held in said aperture against said leg element by said resilient element.

* * * * *